US009091993B2

(12) United States Patent
Sakuma et al.

(10) Patent No.: US 9,091,993 B2
(45) Date of Patent: Jul. 28, 2015

(54) POST-PROCESSING DEVICE, AND IMAGE FORMING APPARATUS

(71) Applicant: FUJI XEROX CO., LTD., Tokyo (JP)

(72) Inventors: Akira Sakuma, Kanagawa (JP); Takeshi Ichikawa, Nagano (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/196,679

(22) Filed: Mar. 4, 2014

(65) Prior Publication Data

US 2015/0001782 A1 Jan. 1, 2015

(30) Foreign Application Priority Data

Jul. 1, 2013 (JP) ..... 2013-138116

(51) Int. Cl.
*G03G 15/00* (2006.01)

(52) U.S. Cl.
CPC .. *G03G 15/6582* (2013.01); *G03G 2215/00814* (2013.01)

(58) Field of Classification Search
USPC ..... 399/407
See application file for complete search history.

(56) References Cited

U.S. PATENT DOCUMENTS

| | | | | |
|---|---|---|---|---|
| 7,137,625 | B2 * | 11/2006 | Yamada et al. | 270/58.07 |
| 7,354,233 | B2 * | 4/2008 | Oki et al. | 412/16 |
| 2002/0060388 | A1 * | 5/2002 | Wakabayashi et al. | 270/58.08 |
| 2005/0100429 | A1 | 5/2005 | Oki et al. | |
| 2007/0231037 | A1 * | 10/2007 | Iida et al. | 399/407 |
| 2009/0200724 | A1 * | 8/2009 | Iguchi et al. | 270/8 |
| 2010/0073449 | A1 * | 3/2010 | Yamamoto et al. | 347/104 |
| 2011/0130260 | A1 * | 6/2011 | Kikkawa et al. | 493/405 |
| 2012/0083400 | A1 * | 4/2012 | Shibasaki et al. | 493/417 |
| 2012/0287450 | A1 * | 11/2012 | Nishi | 358/1.9 |

FOREIGN PATENT DOCUMENTS

| | | |
|---|---|---|
| JP | A-2005-144766 | 6/2005 |
| JP | A-2005-161478 | 6/2005 |
| JP | A-2011-105494 | 6/2011 |

* cited by examiner

*Primary Examiner* — Anthony Nguyen
(74) *Attorney, Agent, or Firm* — Oliff PLC

(57) ABSTRACT

Provided is a post-processing device including a transport path that includes a first transport path which is bent in one direction and a second transport path which is continuous from the first transport path and is bent in the other direction, and that is directed vertically downward while being bent, a first processing unit that is disposed in the first transport path, a second processing unit that is disposed in the second transport path, and a third transport path that is continuous from the second transport path and that is directed vertically upward.

15 Claims, 7 Drawing Sheets

POST-PROCESSING DEVICE, AND IMAGE FORMING APPARATUS

CROSS-REFERENCE TO RELATED APPLICATIONS

This application is based on and claims priority under 35 USC 119 from Japanese Patent Application No. 2013-138116 filed Jul. 1, 2013.

BACKGROUND

Technical Field

The present invention relates to a post-processing device, and an image forming apparatus.

SUMMARY

According to a post-processing device including:

a transport path that includes a first transport path which is bent in one direction and a second transport path which is continuous from the first transport path and is bent in the other direction, and that is directed vertically downward while being bent;

a first processing unit that is disposed in the first transport path;

a second processing unit that is disposed in the second transport path; and a third transport path that is continuous from the second transport path and that is directed vertically upward.

BRIEF DESCRIPTION OF THE DRAWINGS

Exemplary embodiments of the present invention will be described in detail based on the following figures, wherein:

FIG. 3A is a diagram showing an example of a movement at a time when a crease is formed, and FIG. 3B is a diagram showing an example of a movement at a time when no crease is formed;

FIG. 4A is a diagram viewed from a side surface with respect to a recording medium transport direction, and FIG. 4B is a diagram viewed from the recording medium transport direction;

DETAILED DESCRIPTION

Next, an exemplary embodiment of the present invention will be described based on the accompanying drawings.

Figure 1:
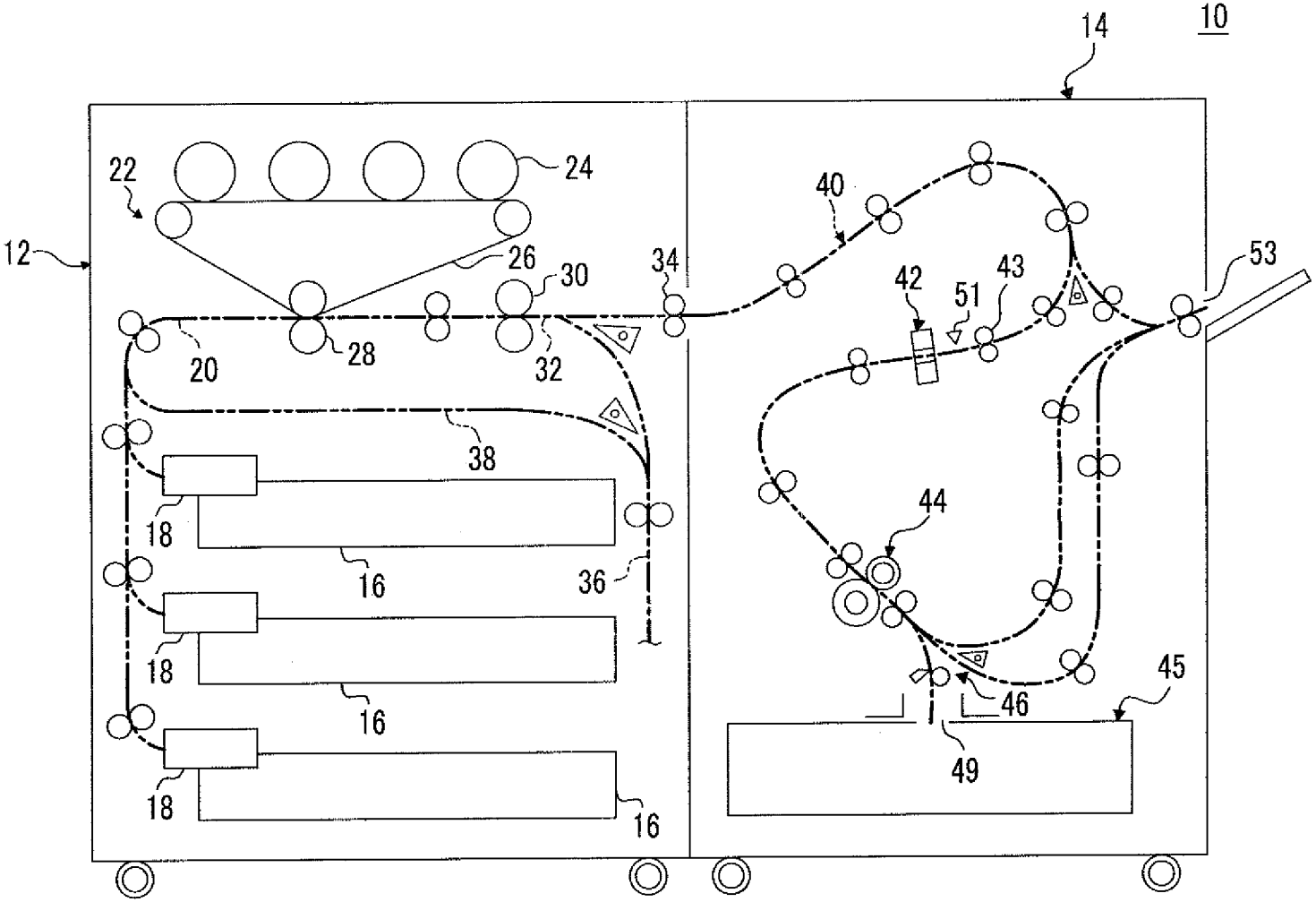
FIG. 1 is an overall configuration diagram of an image forming apparatus according to an exemplary embodiment of the present invention.

FIG. 1 is a cross-sectional diagram showing an image forming apparatus 10 according to the exemplary embodiment of the present invention.

The image forming apparatus 10 includes an image forming apparatus main body 12 and a post-processing device 14. The image forming apparatus main body 12 includes, for example, three-stage recording medium supply cassettes 16, and a supply head 18 is disposed in each of the recording medium supply cassettes 16.

When one of the recording medium supply cassettes 16 is selected, the supply head 18 is operated and a recording medium P is supplied from the selected recording medium supply cassette 16 to an image forming section 22 via a recording medium supply path 20.

Yellow, magenta, cyan, and black photoconductors 24 are disposed side by side and an intermediate image transfer belt 26 is disposed in the image forming section 22.

A charging device, an exposure device, a developing device, a primary image transfer device, a cleaning device and the like (not shown) are placed around the photoconductors 24, and a toner image that is formed in each of the photoconductors 24 is transferred to the intermediate image transfer belt 26. In a case of a black-and-white setting, only the black is operable.

The toner image of the intermediate image transfer belt 26 is transferred by a secondary image transfer roller 28 onto a recording medium P that is sent, and is fixed by a fixing device 30. The recording medium P on which the toner image is fixed is discharged by a discharge roller 34 through a recording medium discharge path 32.

In a case where duplex printing is set, the recording medium P whose surface is fixed by the fixing device 30 is sent from the recording medium discharge path 32 to a reversing device 36, is reversed by the reversing device 36, is sent to a recording medium reversing path 38, is returned back to the recording medium supply path 20, and is sent to the image forming section 22 so that back-surface printing is performed.

Next, the post-processing device 14 according to the exemplary embodiment of the present invention will be described.

Figure 2:
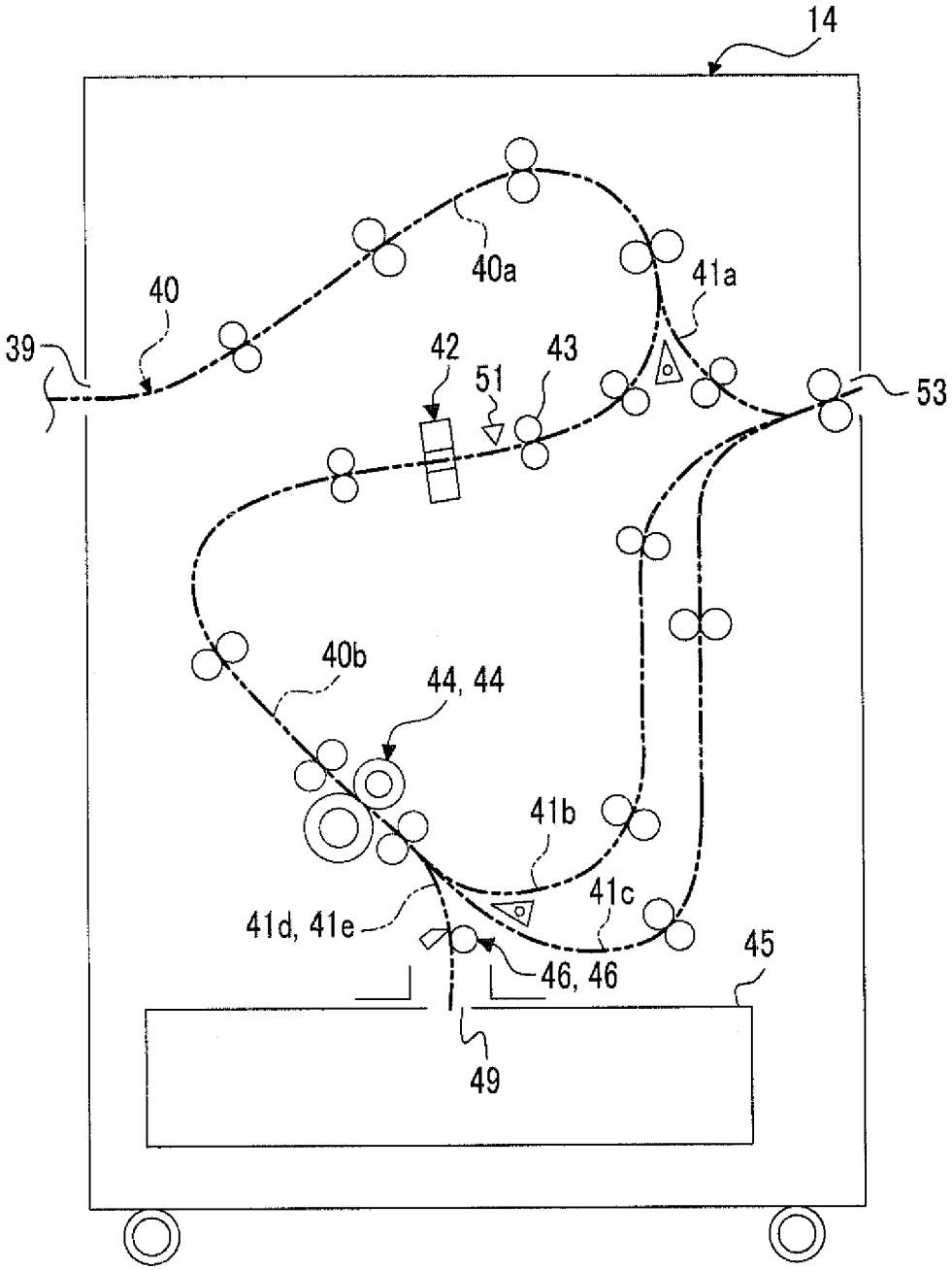
FIG. 2 is a diagram showing a post-processing device that is used in the image forming apparatus according the exemplary embodiment of the present invention.

As shown in FIG. 2, the post-processing device 14 includes a transport path 40 as a transport unit that transports the recording medium, a correction unit 43 that corrects an inclination (registration and skew) of the recording medium P that is transported from the recording medium transport direction upstream side, a detection unit 51 such as a line sensor that detects the recording medium P that is corrected by the correction unit 43, a crease forming unit 42 that puts a crease onto the recording medium P which is transported, cutting units 44 and 44 that cut the transported recording medium P in a transport direction thereof, and an accommodating section 45 that is disposed below the cutting units 44 and 44 and accommodates an unnecessary portion CP of the recording medium P which is cut by the cutting units 44 and 44. Cutting sections 46 and 46 are disposed above an inlet port 49 of the accommodating section 45 to further finely cut the unnecessary portion CP of the recording medium which is cut by the cutting units 44 and 44.

The transport path 40 has an S shape, and includes a first transport path 40*a* that is bent in one direction and a second transport path 40*b* that continues from the first transport path 40*a* and is bent in the other direction.

The crease forming unit 42 as a first processing unit that performs processing on the transported recording medium P is disposed on the first transport path 40*a*.

The cutting units 44 and 44 as second processing units that perform processing on the transported recording medium P are disposed on the second transport path 40*b*. Two cutting units 44 are disposed in a width direction of the second transport path 40*b*.

The second transport path 40*b* branches into a branch path 41*b* and a branch path 41*c* as third transport paths that are directed vertically upward toward a discharge port 53, and a branch path 41*d* and a branch path 41*e* that are directed vertically downward toward the accommodating section 45 on the recording medium transport direction downstream side from the cutting units 44 and 44.

The branch path 41*c* is a transport path through which the processed recording medium P is transported toward the discharge port 53. The branch path 41*b* is a transport path on which the processed recording medium P is held, and has a function as a buffer unit to transport the recording medium to the discharge port 53 simultaneously (in a superimposed manner) with or successively to the recording medium transported from the branch path 41*c*. The branch path 41*d* and the branch path 41*e* are transport paths that branch from both ends of the branch path 41*c*, are disposed in parallel with each other, and transport the unnecessary portion CP of the recording medium cut by the cutting units 44 and 44 toward the accommodating section 45.

The first transport path 40*a* branches into a branch path 41*a* as a fourth transport path on the recording medium transport direction upstream side from the correction unit 43. The branch path 41*a* is a transport path through which the recording medium P is taken out to the discharge port 53 (out of the post-processing device 14) without passing through the processing unit. In a case where no processing is performed on the recording medium P, the recording medium P is transported and discharged out of the discharge port 53.

Herein, the length of the transport path from the crease forming unit 42 to the cutting unit 44 is at least equal to the length of the recording medium P that is transported. Also, the length of the transport path 40 from an inlet 39 of the transport path 40 to the correction unit 43 is at least equal to the length of the recording medium P that is transported.

Figure 3A:
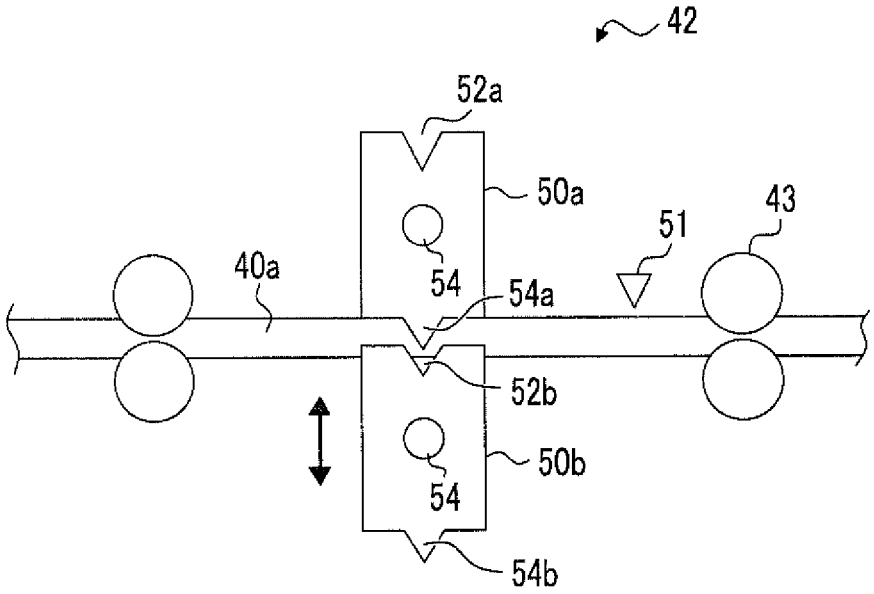
FIGS. 3A and 3B are diagrams showing a crease forming unit that is used in the post-processing device according to the exemplary embodiment of the present invention.
Figure 3B:
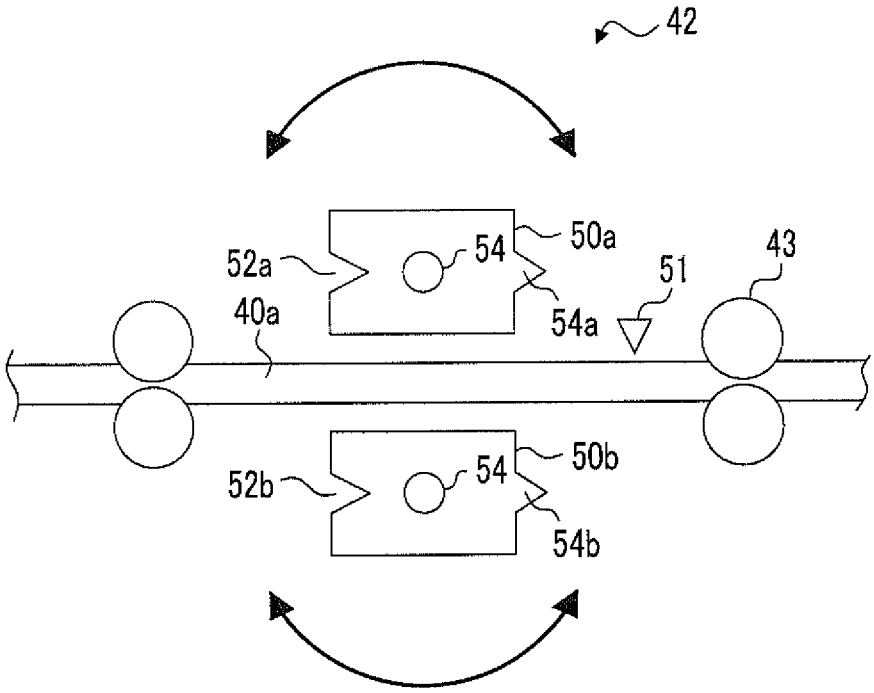

FIGS. 3A and 33 show the crease forming unit 42 according to the exemplary embodiment of the present invention, FIG. 3A shows an example of a movement in a case where the crease is formed in the recording medium P, and FIG. 3B shows an example of a movement in a case where no crease is formed in the recording medium P.

The crease forming unit 42 includes an upper block 50*a* that is disposed above and a lower block 50*b* that is disposed below with the first transport path 40*a* being interposed therebetween.

A recessed portion 52*a* is formed in one surface of the upper block 50*a* and a convex portion 54*a* is formed on a surface on the other side of the recessed portion 52*a*.

A recessed portion 52*b* is formed in one surface of the lower block 50*h* and a convex portion 54*b* is formed on a surface on the other side of the recessed portion 52*b*.

The recessed portion 52*a* of the upper block 50*a* and the convex portion 54*b* of the lower block 50*b* are fitted into each other, and the convex portion 54*a* of the upper block 50*a* and the recessed portion 52*b* of the lower block 50*b* are fitted into each other.

Shaft portions 54 are respectively disposed substantially at centers of the upper block 50*a* and the lower block 50*b*, each of which is held to be rotatable about the shaft portion 54.

Also, the lower block 50*b* is movable in a substantially vertical direction (up-down direction) with respect to the first transport path 40*a* by a not-shown mechanism.

In other words, in a case where the crease is formed in the transported recording medium P, the convex portion 54*a* of the upper block 50*a* and the recessed portion 52*b* of the lower block 50*b* rotate to positions opposing the first transport path 40*a* as shown in FIG. 3A, and the lower block 50*b* is moved upward substantially vertically to the first transport path 40*a*. Also, the recessed portion 52*a* of the upper block 50*a* and the convex portion 54*b* of the lower block 50*b* rotate to positions opposing the first transport path 40*a*, and the lower block 50*b* is moved upward in a substantially vertical direction with respect to the first transport path 40*a*. In this manner, a crease in an opposite direction from the above-described crease is formed.

In other words, each of the upper block 50*a* that has at least two shapes and the lower block 50*b* that has at least two shapes is rotatable, and thus a direction of the crease formed in the recording medium P may be changed.

Figure 4A:
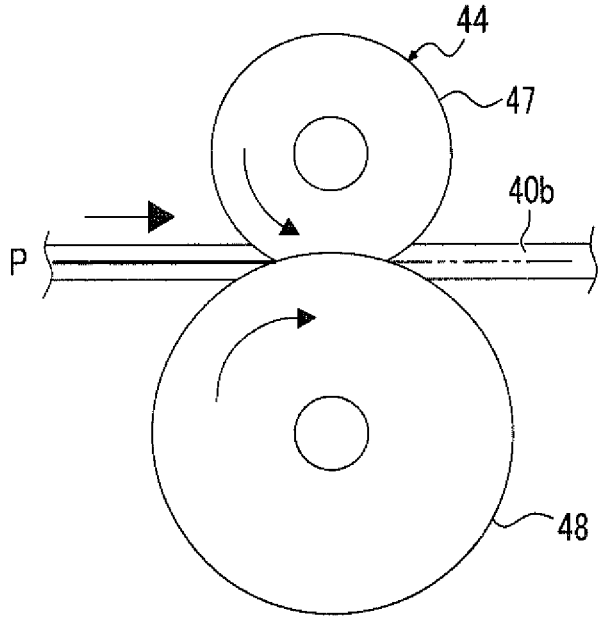
FIGS. 4A and 4B are diagrams showing a cutting unit that is used in the post-processing device according to the exemplary embodiment of the present invention.
Figure 4B:
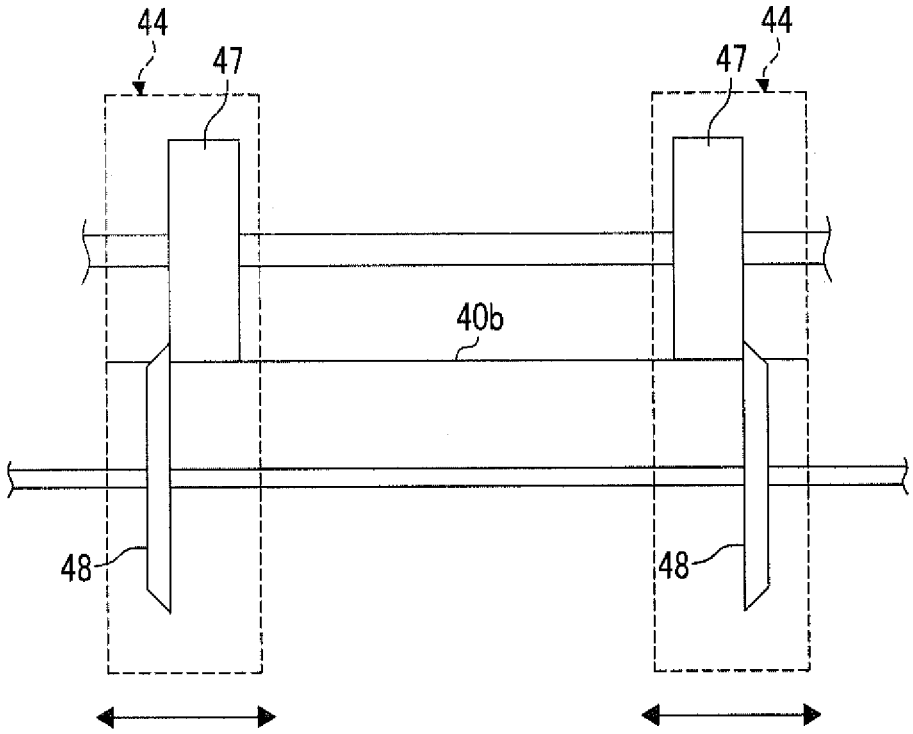

FIGS. 4A and 4B are diagrams showing the cutting unit according to the exemplary embodiment of the present invention, FIG. 4A is a diagram viewed from a side surface with respect to a recording medium transport direction, and FIG. 4B is a diagram viewed from the recording medium transport direction.

As shown in FIG. 4A, the cutting unit 44 includes a pressing unit 47 that is disposed above and a rotary cutter 48 that is disposed below with the second transport path 40*b* being interposed therebetween. Also, as shown in FIG. 4B, two cutting units 44 are disposed in a width direction of the second transport path 40*b*.

The rotary cutter 48 is placed at apart of the recording medium P that is cut, rotates in a clockwise direction, and cuts the recording medium P while transporting the recording medium P.

The pressing unit 47 is placed at a position opposing the rotary cutter 48, and rotates in a counterclockwise direction to press the recording medium P that is cut.

In other words, the rotary cutters 48 and 48 that are disposed at positions opposing the second transport path 40*b* are rotated in a reverse direction to the pressing units 47 and 47 while the rotating pressing units 47 and 47 press both ends of the recording medium P that is transported so that the recording medium P is cut in the transport direction of the recording medium P and both of the ends (top and bottom parts) of the recording medium P are cut.

Also, the cutting units 44 and 44 are moved leftward and rightward according to a cutting width with a cutting position being positioned through detection by the detection unit 51.

Figure 5:
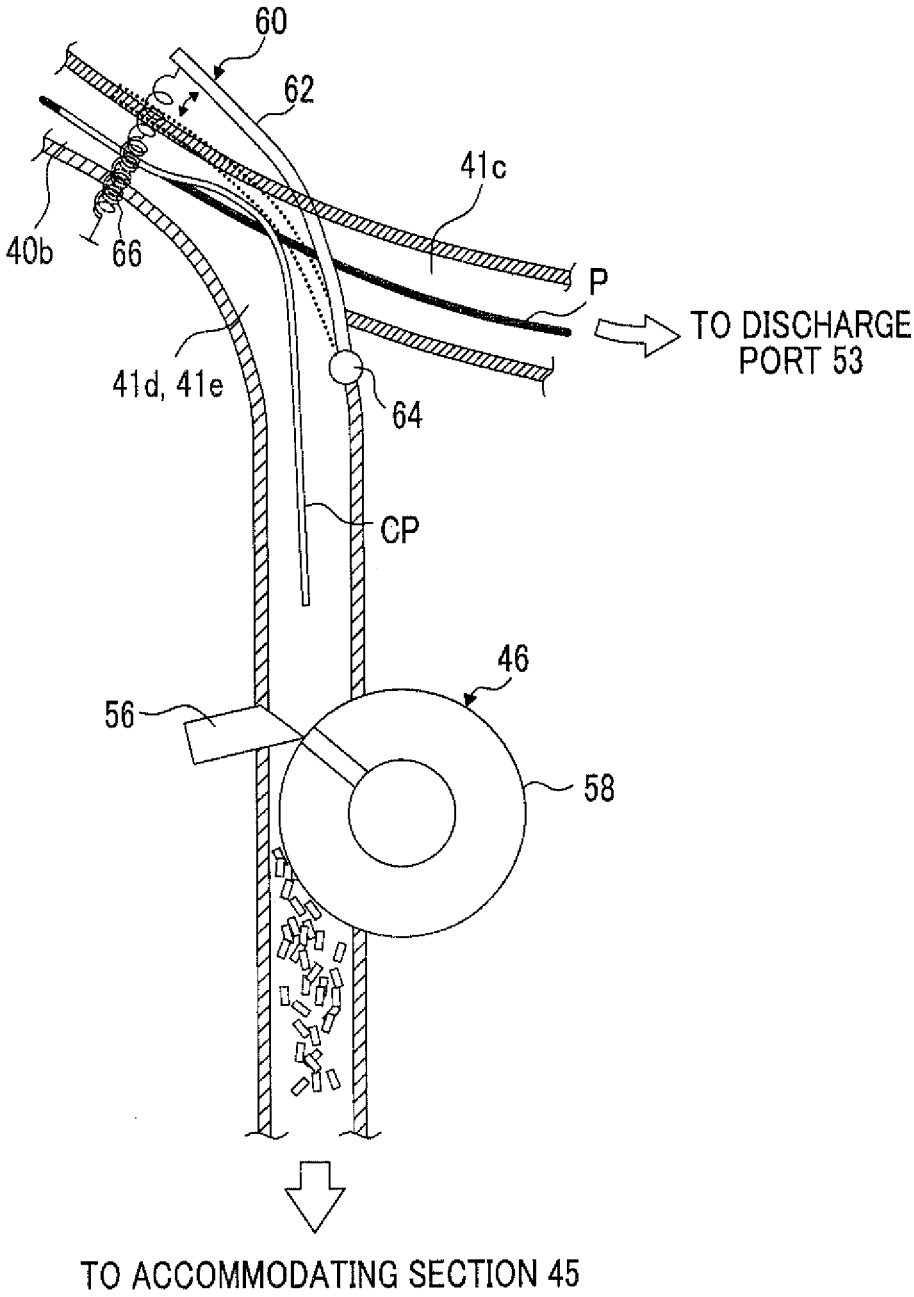
FIG. 5 is a diagram showing a vicinity of a cutting section that is used in the post-processing device according to the exemplary embodiment of the present invention.

FIG. 5 shows a vicinity of the cutting section 46 according to the exemplary embodiment of the present invention.

The cutting section 46 is disposed on each of the branch path 41*d* and the branch path 41*e*.

Herein, the cutting sections 16 that are disposed on the branch path 41*d* and the branch path 41*e* have the same configuration, and thus only the branch path 41*d* will be described.

The cutting section 46 includes a fixed blade 56 and a rotary blade 58.

The fixed blade 56 is disposed to be fixed to the branch path 41*d*. The rotary blade 58 is disposed at a position opposing the fixed blade 56 across the branch path 41*d*. When the rotary blade 58 is rotated, the unnecessary portion CP of the recording medium that passes between the fixed blade 56 and the rotary blade 58 is finely cut.

Herein, the unnecessary portion CP is transported to the branch path 41*d*, and the recording medium P from which the unnecessary portion is cut is transported to the branch path 41*c* and is transported toward the discharge port 53. In this case, if cutting of the unnecessary portion CP is performed by the cutting section 46 during the transport of the recording medium P from which the unnecessary portion CP is cut, the unnecessary portion CP is momentarily stopped in the cutting section 46. This may result in a loop (bending) and jamming (jam) of the unnecessary portion CP. In this exemplary embodiment, movable members 60 and 60 as loop absorption units (bending absorption units) that absorb the loop are respectively disposed at branch parts of the branch path 41*d* and the branch path 41*e* where the loop is generated.

The movable member 60 includes a movable section 62 as a chute, a fulcrum 64 that is disposed in a recording medium transport direction downstream side end portion of the movable section 62, and an urging member 66 such as a spring that is disposed in a recording medium transport direction upstream side end portion of the movable section 62. The movable section 62 is formed of a soft material such as silicon. In other words, the recording medium transport direction upstream side of the movable member 60 is open to the second transport path 40*b* and, in a case where the loop is generated, the recording medium transport direction upstream side of the movable member 60 is opened by a loop force with the fulcrum 64 being a fulcrum to absorb the loop. In this manner, the jamming jam) of the recording medium that passes through the cutting sections 46 is prevented.

Figure 6:
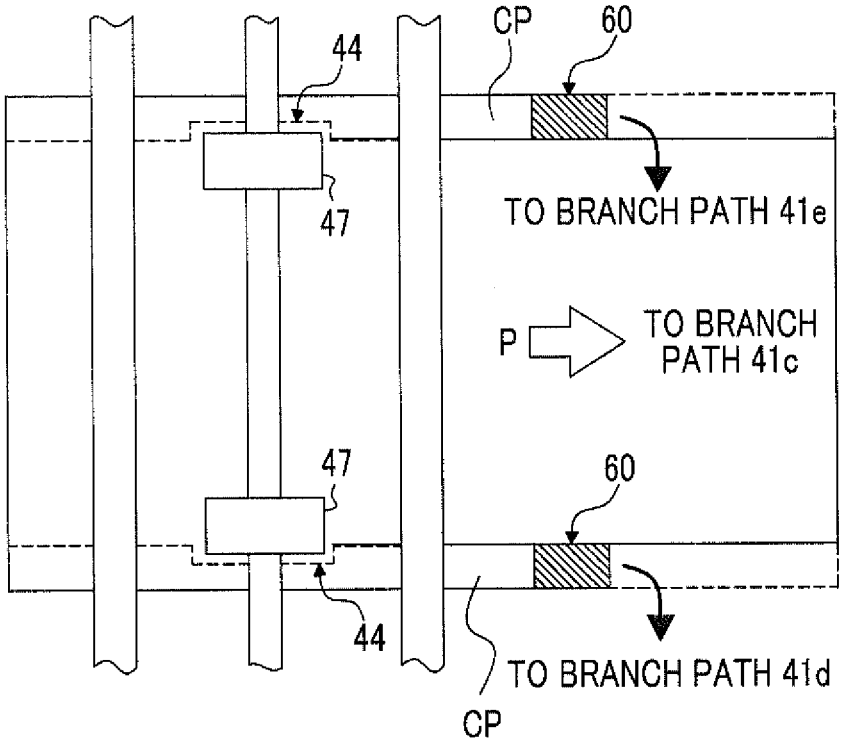
FIG. 6 is a diagram, viewed from above, of the vicinity of the cutting unit that is used in the post-processing device according to the exemplary embodiment of the present invention.
Figure 7:
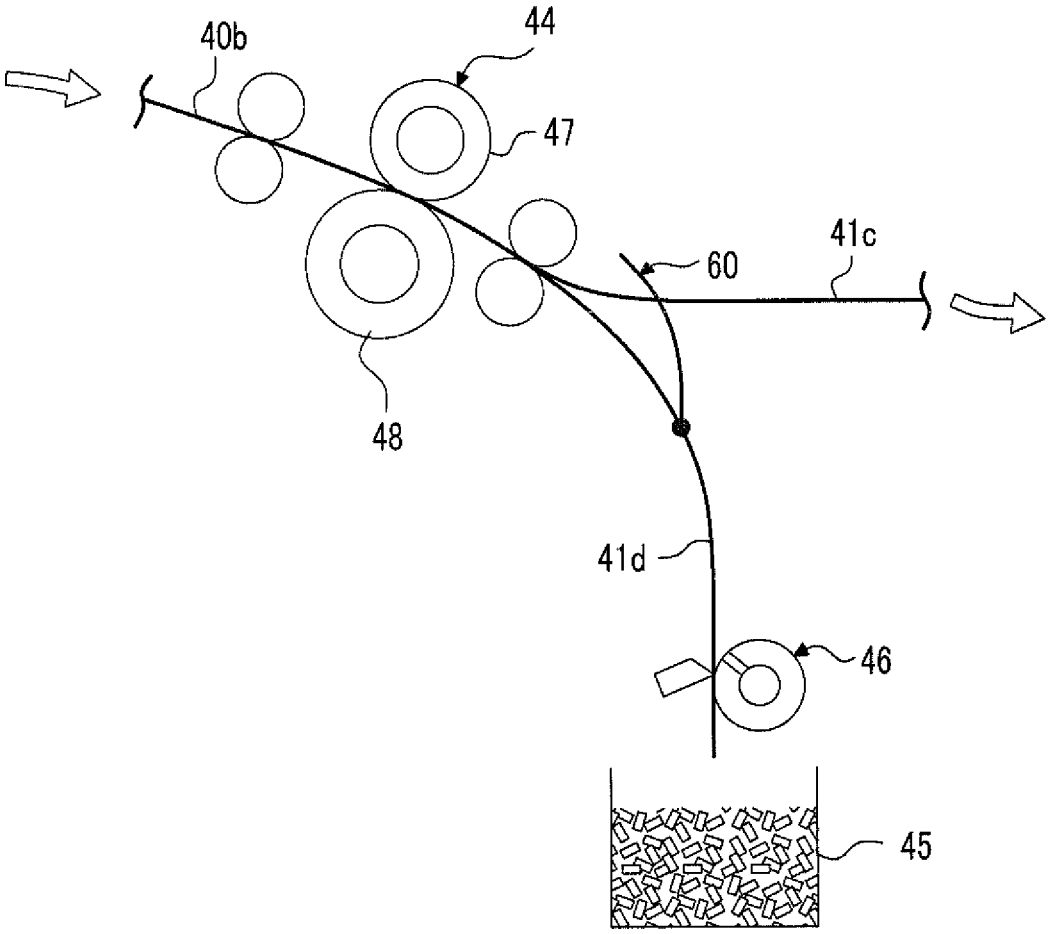
FIG. 7 is a schematic diagram showing a transport path from the cutting unit to an accommodating section that are used in the post-processing device according to the exemplary embodiment of the present invention.

FIG. 6 is a diagram, viewed from above, of the vicinity of the cutting units 44 and 44, and FIG. 7 is a schematic diagram showing the transport path from the cutting unit 44 to the accommodating section 45.

As shown in FIGS. 6 and 7, the unnecessary portion CP of the recording medium that is cut by the cutting units 44 and 44 is guided to the movable member 60, is transported to the branch path 41*d* and the branch path 41*e*, respectively passes through the cutting sections 46 and 46, is further finely cut, and is accommodated in the accommodating section 45. The unnecessary portion CP that is accommodated in the accommodating section 45 is discarded by a user substantially horizontally removing the accommodating section 45. In this case, the accommodating section 45 may be temporarily put on a floor. After the accommodating section 45 is removed from the apparatus main body in a state of being put on the floor, a plastic bag that is set on the accommodating section 45 is tied and removed with both hands in advance so that the unnecessary portion CP does not scatter, a new plastic bag is set, and the accommodating section 45 is returned to the apparatus main body. The plastic bag may not be required, but the unnecessary portion CP may be directly removed and discarded from the accommodating section 45. The recording medium P from which the unnecessary portion is cut is transported to the branch path 41*c* and discharged to the discharge port 53.

The recording medium P that is discharged from the discharge port 53 is transported to an additional post-processing device 2, and the recording medium superimposed with the buffer unit is folded along the crease to be bound. Because heights of the discharge port 53 and the inlet 39 are almost equal to each other, the additional post-processing device 2 can be mounted on the image forming apparatus main body 12 even in a case where the post-processing device 14 of this exemplary embodiment is not mounted. The post-processing device 2 may not be mounted, but the recording medium removed from the discharge port 53 may be received by the user as it is.

In this exemplary embodiment, an example in which the crease forming unit 42 and the cutting unit 44 are used in the post-processing device 14 has been described, but the crease forming unit 42 and the cutting unit 44 may be used in another post-processing device that performs other processing without being limited thereto.

Also, in this exemplary embodiment, an example in which the unnecessary portion CP of the recording medium is accommodated in the one accommodating section 45 from the branch path 41*d* and the branch path 41*e* has been described, but two accommodating sections 45 may be disposed frontward and rearward and the unnecessary portion CP of the recording medium may be accommodated in each of the accommodating sections 45 and 45 respectively from the branch path 41*d* and the branch path 41*e*.

The present invention is not limited to the above-described exemplary embodiment.

As described above, the present invention may be applied to image forming apparatuses, examples of which include copiers, printers, and facsimile machines.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a transport path that includes a first transport path which is bent in one direction and a second transport path which is continuous from the first transport path and is bent in the other direction, and that is directed vertically downward while being bent;

a first processing unit that is disposed in the first transport path;

a second processing unit that is disposed in the second transport path, wherein the second processing unit is a cutting unit that cuts a recording medium that is transported in a transport direction thereof; and a third transport path that is continuous from the second transport path and that is directed vertically upward.

2. The post-processing device according to claim 1, wherein the first processing unit is a crease forming unit that forms a crease onto the recording medium which is transported.

3. The post-processing device according to claim 1, further comprising:

an accommodating section that accommodates an unnecessary portion of the recording medium which is cut below the cutting unit.

4. The post-processing device according to claim 2, further comprising:

an accommodating section that accommodates an unnecessary portion of the recording medium which is cut below the cutting unit.

5. The post-processing device according to claim 3, further comprising:

a cutting section that cuts the unnecessary portion of the recording medium which is cut at an inlet of the accommodating section.

6. The post-processing device according to claim 4, further comprising:

a cutting section that cuts the unnecessary portion of the recording medium which is cut at an inlet of the accommodating section.

7. The post-processing device according to claim 2, wherein a length of the transport path from the crease forming unit to the cutting unit is equal to or larger than a length of the recording medium which is transported.

8. The post-processing device according to claim 3, wherein a length of the transport path from the crease forming unit to the cutting unit is equal to or larger than a length of the recording medium which is transported.

9. The post-processing device according to claim 4, wherein a length of the transport path from the crease forming unit to the cutting unit is equal to or larger than a length of the recording medium which is transported.

10. The post-processing device according to claim 5, wherein a length of the transport path from the crease forming unit to the cutting unit is equal to or larger than a length of the recording medium which is transported.

11. The post-processing device according to claim 6, wherein a length of the transport path from the crease forming unit to the cutting unit is equal to or larger than a length of the recording medium which is transported.

12. The post-processing device according to claim 2, further comprising:

a correction unit that corrects an inclination of the recording medium which is transported and a detection unit that detects the recording medium which is transported on a recording medium transport direction upstream side of the crease forming unit, wherein a length of the transport path from an inlet of the transport path to the correction unit is equal to or larger than a length of the recording medium which is transported.

13. The post-processing device according to claim 1, wherein the third transport path includes a plurality of paths, and wherein the plurality of paths serve as buffer units that overlap the recording medium which is processed in the first processing unit and/or the second processing unit.

14. The post-processing device according to claim 1, further comprising:

a fourth transport path that branches from the first transport path and is that directed to the third transport path.

15. An image forming apparatus comprising:

an image forming apparatus main body; and a post-processing device that is removably mounted on the image forming apparatus main body, wherein the post-processing device includes:

a transport path that includes a first transport path which is bent in one direction and a second transport path which is continuous from the first transport path and is bent in the other direction, and that is directed vertically downward while being bent;

a first processing unit that is disposed in the first transport path;

a second processing unit that is disposed in the second transport path, wherein the second processing unit is a cutting unit that cuts a recording medium that is transported in a transport direction thereof; and a third transport path that is continuous from the second transport path and that is directed vertically upward.

* * * * *